United States Patent [19]

Fasham et al.

[11] Patent Number: 4,765,653

[45] Date of Patent: Aug. 23, 1988

[54] HOSPITAL FORM SET WITH DETACHABLE BAG

[75] Inventors: Thomas I. K. Fasham, Brighton; Harry Irvine, Romford, both of England

[73] Assignee: Moore Business Forms, Inc., Grand Island, N.Y.

[21] Appl. No.: 942,028

[22] Filed: Dec. 15, 1986

Related U.S. Application Data

[63] Continuation of Ser. No. 649,843, Sep. 11, 1984, abandoned.

[30] Foreign Application Priority Data

Sep. 14, 1983 [GB] United Kingdom ..... 24569

[51] Int. Cl.[4] ..... B41L 1/20; B41L 1/22

[52] U.S. Cl. ..... 282/1 R; 282/11.5 R; 282/25; 283/1 B; 283/900; 229/71

[58] Field of Search ..... 283/1 B, 900; 282/1 R, 282/11.5 R, 25, 29 R; 229/69, 71, 74

[56] References Cited

U.S. PATENT DOCUMENTS

| | | | |
|---|---|---|---|
| 2,983,525 | 5/1961 | Mercur | 282/25 |
| 3,117,608 | 1/1964 | Goss et al. . | |
| 3,278,015 | 10/1966 | Bernstein | 206/232 |
| 3,730,355 | 5/1973 | Feldman | 211/59.1 |
| 3,837,565 | 9/1974 | Johnsen . | |
| 3,986,613 | 10/1976 | Mayer | 211/57.1 |
| 4,153,163 | 5/1979 | Alderman et al. . | |
| 4,236,731 | 12/1980 | Hektoen . | |
| 4,440,298 | 4/1984 | Knight | 206/232 |
| 4,706,996 | 11/1987 | Fasham | 283/900 X |

FOREIGN PATENT DOCUMENTS

| | | |
|---|---|---|
| 2066209 | 7/1981 | United Kingdom . |
| 2081215A | 2/1982 | United Kingdom . |

*Primary Examiner*—P. W. Echols
*Assistant Examiner*—Taylor J. Ross
*Attorney, Agent, or Firm*—Allegretti & Witcoff, Ltd.

[57] ABSTRACT

This invention is concerned with a business forms assembly system for medical use, particularly in hospitals, which are capable of being able to record a medical test, for example, a blood test, which assembly comprises a backing sheet with one part of the backing sheet having a transparent sheet secured thereto to provide a bag to contain a medical sample and another part thereof intended to receive information about the medical sample. The system also utilizes a retainer for supporting the bag containing the medical samples.

4 Claims, 4 Drawing Sheets

HOSPITAL FORM SET WITH DETACHABLE BAG

This application is a continuation of application Ser. No. 649,843, filed Sept. 11, 1984, now abandoned.

BACKGROUND OF THE INVENTION

Field of the Invention and Description of the Prior Art

This invention has reference to business forms assemblies and has particular reference to business forms assemblies for medical use, for example, in hospitals which are capable of recording a medical test, for example, a blood test, and having means associated with the business form assembly for securing a sample of the medical test.

In British Specification No. 2081215, there is described a bag with a compartment to receive a container, for example, for a blood sample, and another compartment to receive a form to carry information about the sample. Adhesive means are provided to close the compartment for the sample container.

SUMMARY OF THE INVENTION

It is an object of the present invention to provide a combined business form and compartment, capable of receiving a sample, containing a blood or other medical sample.

According to the present invention, a business forms assembly comprises a backing sheet with one part of the backing sheet having a transparent sheet secured thereto to provide a bag to contain a medical sample and another part thereof intended to receive information about the medical sample.

Preferably, a line of fold perforations is provided between the transparent sheet part, and the information part and a line of adhesive is provided on the information part and is arranged so that, when the assembly is folded about the line of fold perforations, to be positioned over the mouth of the bag, the bag is closed. Conveniently, the invention also comprises a business forms retainer system comprising a continuous bar having a plurality of limbs, the lower limb of which is capable of supporting a plurality of business forms assemblies and which lower limb passes through an aperture in the respective assemblies.

BRIEF DESCRIPTION OF THE DRAWINGS

A business forms assembly in accordance with the present invention will now be described by way of example with reference to the accompanying drawings wherein.

DETAILED DESCRIPTION OF THE PREFERRED EMBODIMENT

Figure 1:
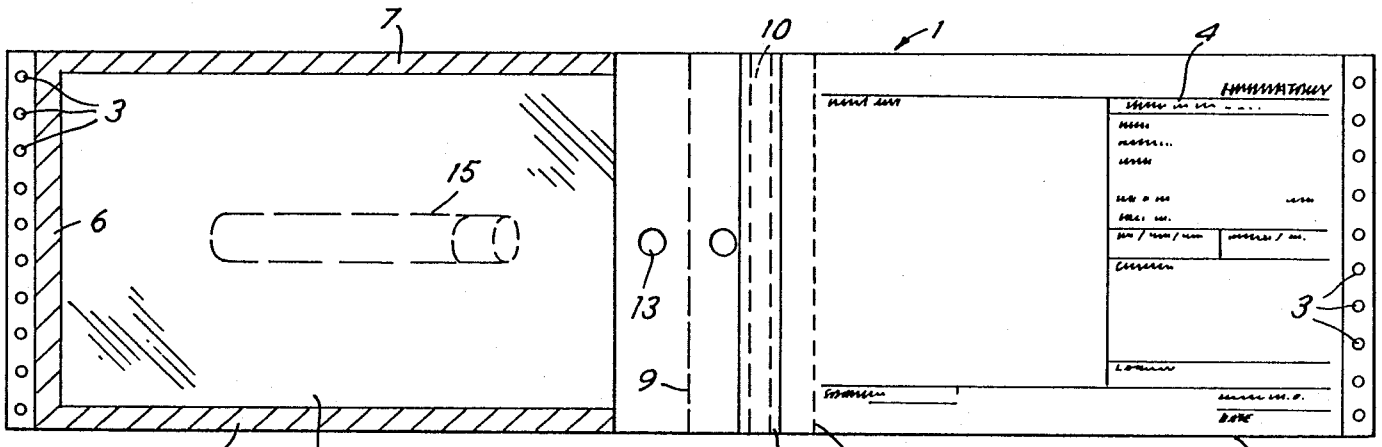
FIG. 1 is a plan view of one part of the forms assembly.
Figure 2:
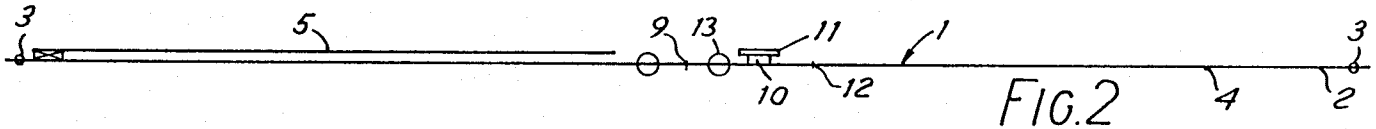
FIG. 2 is a side view of the forms assembly of FIG. 1.

Referring to FIGS. 1 and 2 of the drawings, there is shown a business forms assembly comprising a backing sheet 1. The backing sheet preferably, comprises a continuous web 2 of business forms stationery of paper, but preferably is of paper laminated with plastics material. The backing sheet has marginal feed apertures 3 at the opposite sides of the web to enable the web to be fed through a typewriter or print unit of a computer, whereby information is applied to the web, as will be hereinafter described, but for some applications, such feed apertures are not necessary. The web also has cross perforations to divide the web into form lengths (only one form being shown in FIG. 1).

The web on the right hand side (as shown in FIGS. 1 and 2) a written data area 4 suitable to receive information about a blood test to be carried out on a patient. Printed matter, including lines defining areas relating to certain kinds of information, and words specifying the kind of information are included. Some of this information to be applied in the respective areas, such as the name and address of the patient, may be applied by label to which data has been applied in a typewriter or like print unit but other information, for example, the results of tests carried out on blood sample, may be inserted by hand on the web.

On the left hand side of the web 2 (as shown in FIGS. 1 and 2), a transparent web 5 is secured by lines of adhesive to the continuous web 2 to form a bag secured on three sides and open on the fourth side. These lines of adhesive include a longitudinal line 6, extending longitudinally of the web 2 and adjacent to the margin of the web 2, and transverse lines of adhesive 7 and 8 extending transversely of the web on opposite sides of the lines of cross perforation for dividing the web into form lengths. The adhesdive is of the kind capable of adhering to both plastics sheet and, to paper and conveniently, is a synthetic resin based emulsion type adhesive, such as sold under the name Envapatch 234 by National Adhesives. The transparent web is suitably of plastics material of the kind which does not tear by hand, unless first cut, and gives good visibility. Polyester film material, and particularly the film material sold under the name of Melinex by ICI P.L.C., is found to be suitable. The transparent web 5 has fed perforations 3 for purpose of registration with the continuous web 2, but this is not absolutely necessary.

A line of fold perforations 9 extends longitudinally of the assembly and is provided centrally of the web between the inner edge of the transparent web 5 and the inner edge of the printed data area 4. A line adhesive 10 extends longitudinally of the web 2 and is positioned between the fold perforations 9 and the inner edge of the printed data area. It is required that the line of fold perforations 9 shall be positioned midway between the inner edge of the transparent web and the center line of adhesive 10. That is to ensure that, when the form length is folded about the line of fold perforations 9, the line of adhesive 10 covers the inner edge of the transparent web 5, one half of the adhesive covering the lip of the transparent web 5 and one half covering the part of the web 2 between the lip of the web 5 and the line of fold perforations 9. As described, the bag, closed on three sides, is formed from the backing web 1 and the transparent web 5, with the lines of adhesive 6, 7 and 8 securing the bottom and sides of the bag. The line of adhesive 10 covering the mouth of the bag closes the bag on the fourth side, thereby providing a completely sealed package.

A barrier sheet 11 covers the line of adhesive 10 to prevent the line of adhesive 10 sticking to other material. The barrier sheet is, preferably, a ribbon of waxed paper.

An additional line of cross perforations 12 is provided between the line of adhesive 10 and area 4 of printed data to enable the printed data area to be detached from the assembly when information recorded on the data area is required for data processing or other purposes.

A pair of apertures 13 are positioned adjacent to and opposite the sides of and equidistant from the line of fold perforations 9 so that when the web is folded about the line 9, the apertures are in register so that the assembly may be suspended on a filing post or in a rail type suspension system to facilitate transport to the laboratory or for storage purposes until such time as they are required.

The printed data area 4 can be detached from the remainder of the form length and the information recorded on the area 4 can be used for the required purposes.

In a typical example, a form length has a width of 17.7 inches (450 mms) and a form depth of 5 inches (127 mm). It is preferred that the backing sheet 1 is of paper, coated with a platics material coating, for example polythene, on the reverse side (that is the outer side). For example, the paper is of 80 grams per square meter bleached kraft sulfate paper covered with a coating of polythene of about 23 grams per square meter.

When a business form, as shown in FIGS. 1 and 2, is to be used for requesting details of blood or other fluid tests to be carried out, a sample of blood is taken from the patient and inserted in a capsule 15 into the bag, made by the backing sheet and transparent web, and closed on three sides in that particular form length. The barrier sheet is then removed and the form length is folded about the fold performation line 9 so that the exposed line of adhesive 10 covers the inner edge of the bag and retains the capsule in the bag. The position of the line of adhesive, when the form length is folded, has half of its area covering the lip of the transparent web 5 and one half covering the pant of the web 2 between the lip of the web 5 and the line of fold perforations. The folded over form length may be supported on a cross bar or filing post extending through the apertures 13 to facilitate transportion to a laboratory. Such a cross bar or filing post may be associated with a filing tray which constitutes a record retained to be hereinafter described. At the laboratory, tests are carried out and the results of these tests are recorded on the printed data area 4 and processed in the usual way as required by the hospital. It wlll be noted that the capsule 15 is contained within the bag, formed by the continuous web 2 and the transparent web 5, and may be removed from the bag by detaching at the line of adhesive 10. Alternatively, the bag may be forced against an immovable surface to force the capsule to burst the bag.

Figure 3:
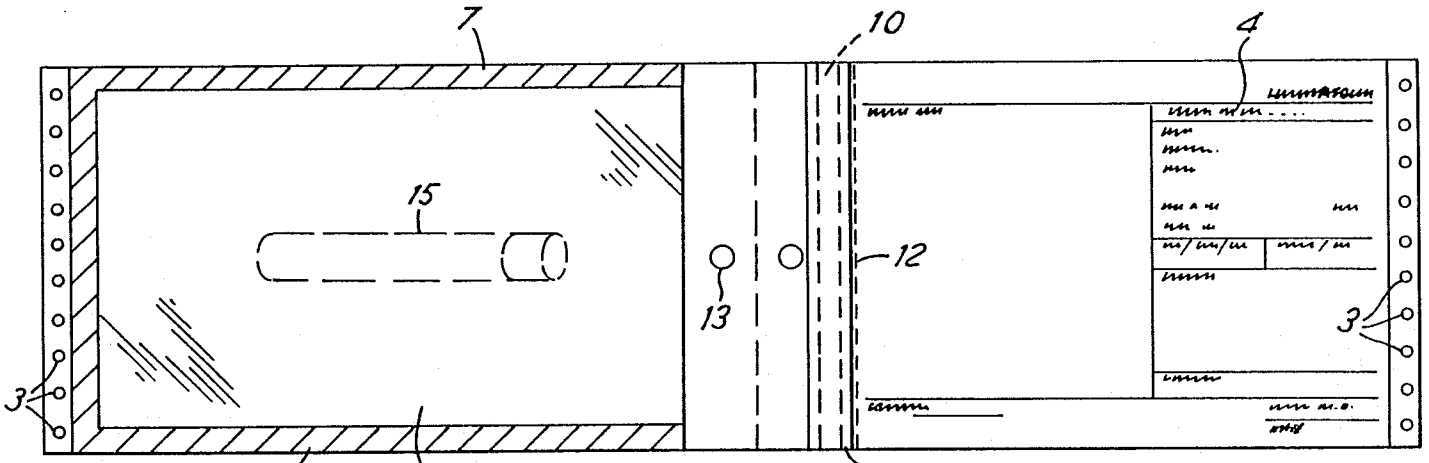
FIG. 3 shows a modification.
Figure 4:
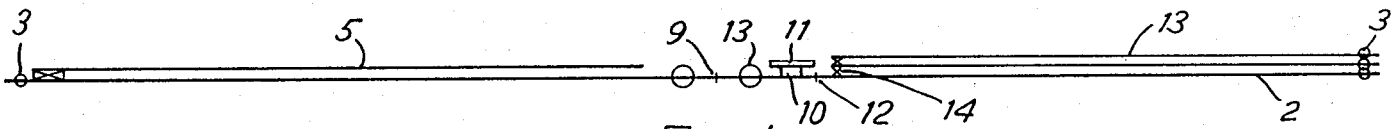
FIG. 4 is a side view of the modification shown in FIG. 3.

A modified construction of business forms assembly is shown in FIGS. 3 and 4 which construction is similar to the construction shown in FIGS. 1 and 2. A pair of duplicate forms sheets 13, which is part of a web extending longitudinally of the business forms assembly, is positioned above the printed data area. The form sheets 13 are printed in the same or similar format as the data area 4. The form sheets 13 are either of self copy paper (such as the self copy paper sold under the Trademark MCP) or the sheets 13 are record sheets and interleaved sheets of transfer carbon paper and positioned between adjacent record sheets for data transfer purposes. The sheets 13 are secured together and to the printed data area by lines of adhesive 14. The inner edges of the sheets 13 are positioned in line with the lines of longitudinal perforations 12. The duplicate forms sheets enable details of information about blood tests, etc. to be recorded on more than one sheet of paper, for example for medical record purposes.

The assembly shown in FIGS. 3 and 4 operates in the same way as the assembly shown in FIGS. 1 and 2, except that additional copy sheets corresponding to the printed data area 4 are provided as may be required.

In a further alternative arrangement, the printed layout of the data area 4 may be reproduced on the back of the continuous web 2, on the side remote from the transparent web 5.

Figure 5:
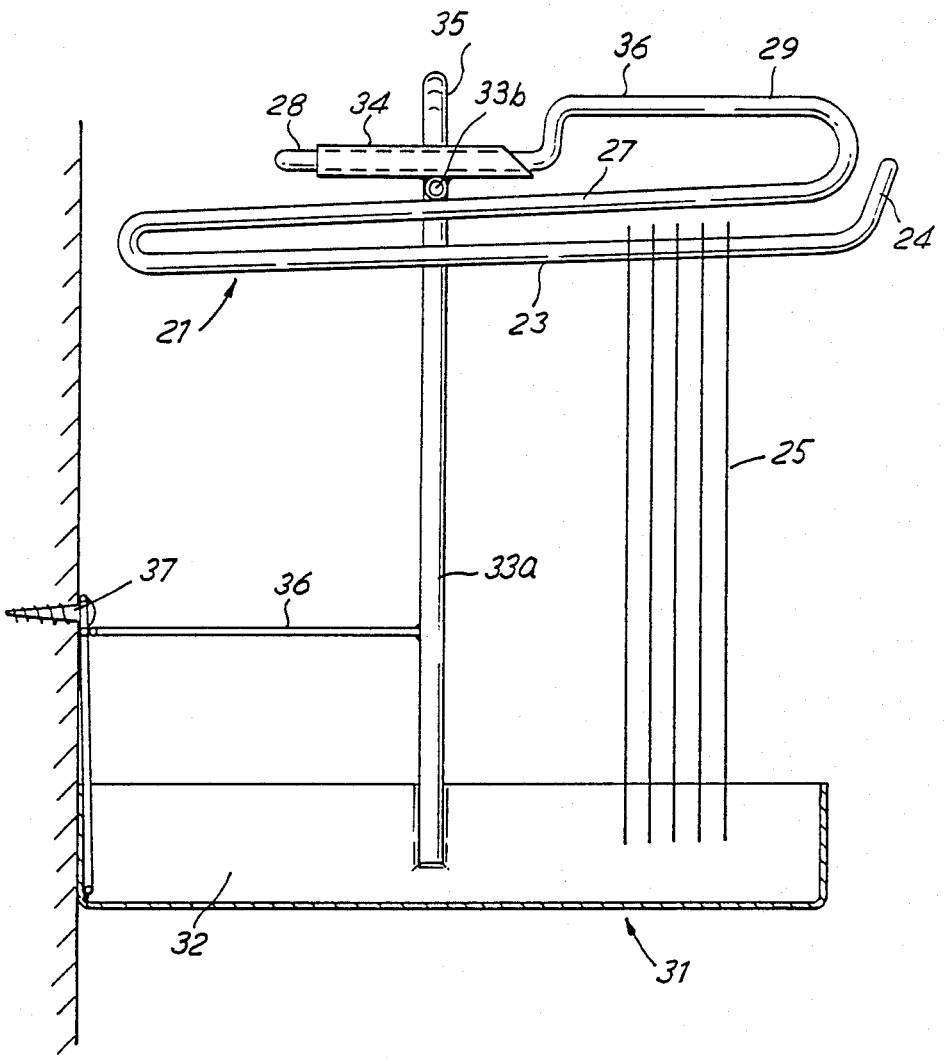
FIG. 5 is a side view of the forms assembly supported on a filing tray.
Figure 6:
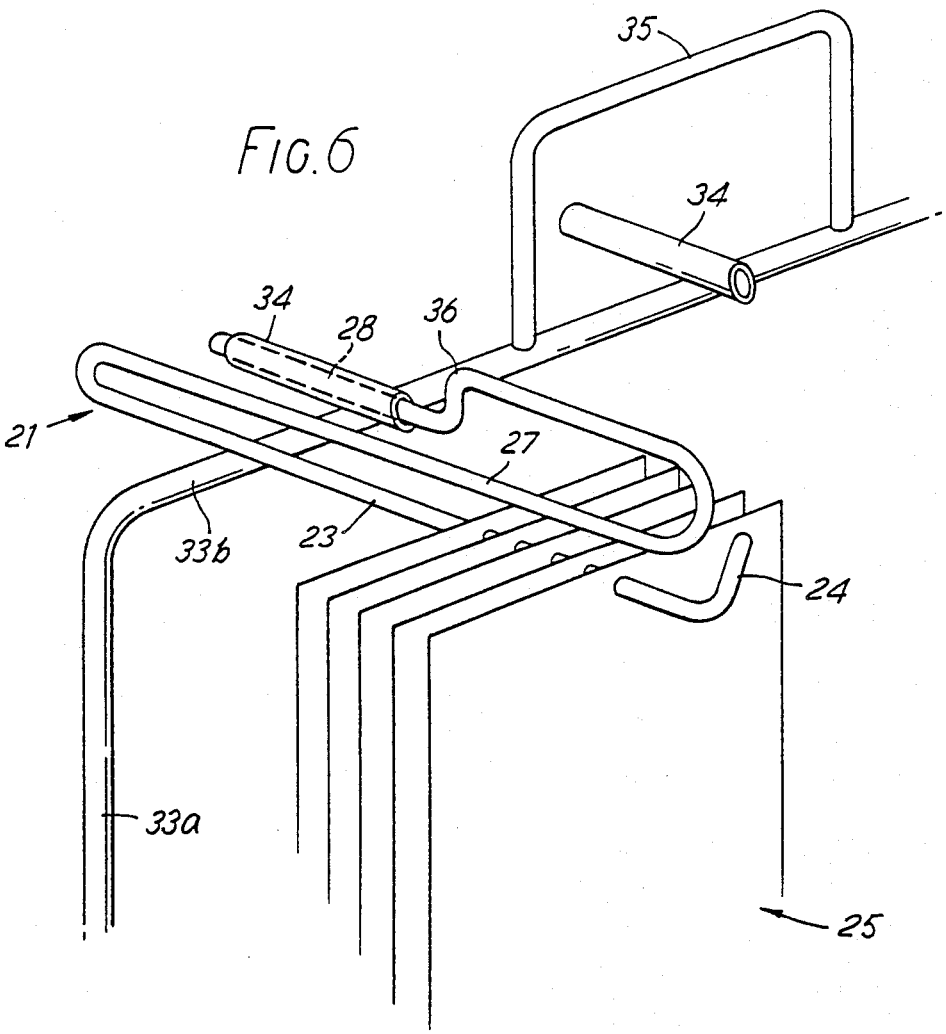
FIG. 6 is a diagrammatic perspective view corresponding to FIG. 5.

Referring to FIGS. 5 and 6 of the drawings, there is shown a record retainer 21 located on a tray 22 (only part of which is shown in FIG. 6). The record retainer 21 comprises a continuous bar of metal for example, of steel covered by a covering of plastics material, for example, polyethylene or polypropylene but preferably of nylon. The nylon covering may be applied first by heat treatment and then by dipping the metal assembly in nylon powder or nylon performer powder. The plastics material must be capable of withstanding steam cleaning and sterilizing, as in an Autoclave. The bar includes a lower limb 23 which is substantially straight and positioned horizonally or nearly so, as as to allow specimens to slide away from the free end but has an upwardly curved free part 24. This lower limb 23 has a diameter slightly less than the diameter of an aperture formed adjacent the upper edge of a business forms assembly shown in FIGS. 1 and 4, divided into a single bag length, and shown diamgrammatically at 25.

The bar also includes an upper limb 26 integrally connected to the lower limb 23 by an intermediate portion 27 to form a carrying handle and so that specimens will slide down when removed from the main assembly. Adjacent its outer end, the upper limb, which has a diameter the same as the diameter of the lower limb 23, has a straight portion 28 positioned substantially horizontally. At about the mid part of the upper limb, the limb bends upwardly and then bends to a further substantially horizontal portion 29, but spaced from the intermediate portion 27 by a larger distance than the distance between the straight limb portion and the intermediate portion. The outer end of the further horizontal portion 29 terminates in a bend which joins the intermediate portion 27.

The record retainer is capable of supporting the forms records 25 on its lower limb 23 end of being supported by a sleeve 34 on the tray 22 to be hereinafter described.

The tray comprises a drip tray base 31 of rectangular form with shallow side walls 32 at each side. An integral handle member 33, with vertical side parts **33*a* and a horizontal top part 33*b*, is secured at the lower end of its side parts 33*a*** to the respective side walls by welding.

A plurality of sleeves 34 are secured, as by welding, to the horizontal top part **33*b* of the handle member. The end of the sleeve 34 to receive the record retainer is chamfered to facilitate insertion of the record retainer in the sleeve. The longitudinal center line of each respective sleeve is positioned above and at right angles to the horizontal top part 33*b*** and each is secured to the top part by welding.

The sleeves are each located in a horizontal plane in the record retainer shown. It is intended that there are three sleeves secured to the top part **33*b* with the sleeves so spaced so that, when the forms records 25 which, when folded, has a depth of approximately nine and one half (9½) inches (24 centimeters) and has a width of approximately five (5) inches (13 centimeters), the forms records assemblies lie close to the tray 22** and the forms records assemblies are positioned in groups which groups lie close to one another side by side.

The handle member 33, as shown, has a carrying handle 35 of similar bar material covered with plastics material which is secured to the top part 33*b*. Also, an extension 36 is formed from the respective side parts and has an eye portion which enables the tray to be mounted on a wall or other surface as by a screw 37. The tray is also covered with a coating of nylon or other platics material. The covering is provided in order that the record retainer and tray may be capable of being subjected to heat treatment such as steam cleaning as in an Autoclave for sterilization purposes.

When a record retainer, as described, is to be used the requested details, for example, of a medical test are entered on a forms record and a sample (for example of blood) is taken and inserted into a container, which in turn is placed in the bag or envelope of the forms records. The bag or envelope is then closed and the forms record is placed on the record retainer with the aperture in the forms record engaged on the lower limb 23. In the record retainer described, there are three separate record retainers, so one retainer may be used to receive sample tests relating to, for example HAEMATOLOGY, another for MICRO BIOLOGY and the third for CLINICAL CHEMISTRY.

When enough forms records are mounted on the record retainer, the record retainer is carried by the horizontal carrying portion to the tray where the upper limb engages a selected one of the sleeves 34. When the sleeves are engaged, the tray with the record retainer is carried to the appropriate laboratory for testing where the records are dealt with and further information about the samples is recorded on the forms records and they are further processed.

Instead of providing a retainer system, with the continuous bar retained on a carrying tray, it may be retained in a carrying case having components similar to the tray but enclosed by panel members.

Figure 7:
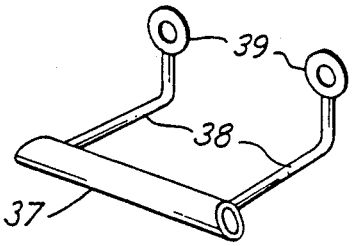
FIG. 7 shows a modification.

Also, instead of supporting the record retainers on the tray member shown in FIGS. 5 and 6, they may be supported on a sleeve 37*a* which is secured, as by welding, to a pair of brackets 38, each with an eye 39 which enables the sleeve to be secured by a screw to a wall or other surface. The opposite ends of the sleeve are chamfered to enable the retainer to be located within the sleeve from either of the two ends shown in FIG. 7.

What is claimed is:

1. A business form assembly system for use with a medical specimen container comprising, in combination, a backing sheet having a first portion and a second portion, perforations for detachably securing said first portion to said second portion, said first portion having opposed side edges, an outer edge, and an inner edge facing said second portion, a transparent sheet secured to only one side of said first portion of said backing sheet, said transparent sheet being the only sheet secured to said first portion, said transparent sheet being secured to said side edges and to said outer edge only, an opening being defined along said inner edge, said transparent sheet, said first portion, and said three secured edges defining a bag for receiving said medical specimen container, said opening permitting the passage of said container in and out of said bag, said second portion defining a record form area for receiving recorded information concerning said medical specimen, both said record form area and said bag being positioned on the same side of said backing sheet when said first and second portions are in an end-to-end relationship, and adhesive means on said first portion, said adhesive means being constructed and arranged to be partially adhesively secured to the outer surface of said transparent sheet along said opening and also being partially adhesively secured to the surface of said first portion along said opening following detachment of said first portion from said second portion, a line of fold perforations being provided in the backing sheet between said transparent sheet and the record form area of said second portion, and said adhesive means being arranged to be positioned over the opening of the bag, when the assembly is folded about the line of fold perforations, a pair of apertures being provided in said first portion and being spaced equidistantly from the line of fold perforations and being so located that, when folded about the line of fold perforations, the apertures are in register the one with the other.

2. A business forms assembly according to claim 1 having a plurality of copy sheets associated with said second portion.

3. A business forms assembly according to claim 1 wherein the assembly is provided with marginal feed apertures.

4. The business forms system of claim 1 including means for selectively vertically supporting said first portion and said second portion.

* * * * *